US007766737B2

(12) United States Patent
Sanders

(10) Patent No.: US 7,766,737 B2
(45) Date of Patent: Aug. 3, 2010

(54) SYSTEM AND METHOD FOR ANALYZING GOLFER PERFORMANCE

(76) Inventor: Peter Sanders, 2810 High Ridge Rd., Stamford, CT (US) 06905-1683

( * ) Notice: Subject to any disclaimer, the term of this patent is extended or adjusted under 35 U.S.C. 154(b) by 711 days.

(21) Appl. No.: 11/669,571

(22) Filed: Jan. 31, 2007

(65) Prior Publication Data

US 2007/0178983 A1 Aug. 2, 2007

Related U.S. Application Data

(60) Provisional application No. 60/763,513, filed on Jan. 31, 2006.

(51) Int. Cl.
*G06F 17/00* (2006.01)
*A63B 57/00* (2006.01)
*A63B 69/36* (2006.01)

(52) U.S. Cl. ..... 463/7; 463/23; 473/131

(58) Field of Classification Search ..... 473/131, 473/198, 407; 273/460; 463/7, 23
See application file for complete search history.

(56) References Cited

U.S. PATENT DOCUMENTS 6,277,029 B1 * 8/2001 Hanley, Jr. ..... 473/131

OTHER PUBLICATIONS

"The 2002-2005 USGA Handicap System Online Manual—Section 1 Purpose and Requirements", 2005, United States Golf Association, available at <http://web.archive.org/web/20041205220304/www.usga.org/playing/handicaps/manual/section_01.html>.*
"The 2002-2005 USGA Handicap System Online Manual—Section 2 Definitions", 2005, United States Golf Association, available at <http://web.archive.org/web/20041205220304/www.usga.org/playing/handicaps/manual/section_02.html>.*
"The 2002-2005 USGA Handicap System Online Manual—Section 10 USGA Handicap Formula", 2005, United States Golf Association, available at <http://web.archive.org/web/20041205220304/www.usga.org/playing/handicaps/manual/section_10.html>.*
Martin, Lawrence, "Why Are You Still a Hacker?", Apr. 19, 2000, Lakeside Press, available at <http://web.archive.org/web/20000419081735/www.lakesidepress.com/Golf/Step6-Shortgame.htm>.*
Oy, Suunto, "Suunto on How Not to Rely on Luck When Lowering Your Handicap", Aug. 2005, available at <http://media.suunto.com/media/suunto/manuals/en_US/golf_guide_en_v3_m56577569830602841.pdf>.*

* cited by examiner

*Primary Examiner*—Dmitry Suhol
*Assistant Examiner*—Werner Garner
(74) *Attorney, Agent, or Firm*—St. Onge Steward Johnston & Reens LLC

(57) ABSTRACT

In a method for analyzing performance of a golfer, a number greens hit in regulation by the golfer during at least one round of golf and a number of long game strokes taken by the golfer during the at least one round of golf are determined, a long game efficiency index of the golfer is calculated by dividing the determined number of long game strokes by the determined number of greens hit in regulation, and a long game handicap of the golfer is determined based at least in part upon the calculated long game efficiency index and a known relationship between long game handicap versus long game efficiency index. The method may be performed by a computer system if desired.

33 Claims, 2 Drawing Sheets

SYSTEM AND METHOD FOR ANALYZING GOLFER PERFORMANCE

CROSS-REFERENCE TO RELATED APPLICATIONS

This application claims the benefit of, under 35 U.S.C. 119 (e), U.S. Provisional Patent Application No. 60/763,513, filed Jan. 31, 2006, which application is hereby incorporated by reference herein.

FIELD OF THE INVENTION

The present invention relates generally to the game of golf, and more specifically, relates to methods, systems and software for analyzing performance of golfers.

BACKGROUND OF THE INVENTION

There currently exist a number of different statistical tools used to analyze golfer performance. A golf game is typically analyzed by the players' abilities in the long game (i.e., from the tee to the green) short game (i.e., any shot within 50 yards of the hole, including putting) and putting. The most commonly used statistical tool for analyzing long game performance is "Greens Hit In Regulation" (GIR's) which is defined as reaching the putting surface (the green) in 3 or less shots on a par 5, 2 or less on a par 4 or 1 on a par 3. The number of GIR's obtained in a given golf round has long been used as an indicator of the quality of the golfer's long game performance.

However, the GIR statistic is incomplete as it does not provide an indication of the golfer's efficiency in the long game. Specifically, it ignores long game performance on all the holes where the player did not record a GIR. Thus, it is conceivable for a golfer to make any number of errors and incur untold penalties in his/her long game on the holes where the green was not reached in regulation. Further, the GIR evaluation does not provide any comparative analysis of the golfer's long game as compared to his/her short game.

What is desired, therefore, is a system and method for analyzing performance of golfers which provide an indication of the golfer's efficiency in the long game, which take into account a golfer's performance on all holes, which provide a comparative analysis of the golfer's long game as compared to his/her short game, and which assign an accurate handicap to the golfer's long game performance and short game performance.

SUMMARY OF THE INVENTION

Accordingly, it is an object of the present invention to provide a system and method for analyzing performance of golfers which provide an indication of the golfer's efficiency in the long game.

Another object of the present invention is to provide a system and method for analyzing performance of golfers having the above characteristics and which take into account a golfer's performance on all holes.

A further object of the present invention is to provide a system and method for analyzing performance of golfers having the above characteristics and which provide a comparative analysis of the golfer's long game as compared to his/her short game.

Still another object of the present invention is to provide a system and method for analyzing performance of golfers having the above characteristics and which assign an accurate handicap to the golfer's long game performance and short game performance.

These and other objects of the present invention are achieved, in accordance with one embodiment of the present invention, by provision of a method for analyzing performance of a golfer comprising the steps of: determining a number greens hit in regulation by the golfer during at least one round of golf; determining a number of long game strokes taken by the golfer during the at least one round of golf; calculating a long game efficiency index of the golfer by dividing the determined number of long game strokes by the determined number of greens hit in regulation; and determining a long game handicap of the golfer based at least in part upon the calculated long game efficiency index and a known relationship between long game handicap versus long game efficiency index.

In some embodiments, the number of greens hit in regulation comprises a number of holes on which the golfer reached a hole's putting surface in at least two strokes less than par for the hole for each hole played during the at least one round of golf. In some embodiments, the number of long game strokes comprises a number of strokes taken or incurred by the golfer from greater than 50 yards from each hole played during the at least one round of golf. In certain of these embodiments, the number of strokes taken or incurred includes strokes taken by the golfer and penalty strokes incurred by the golfer. In some embodiments, the step of determining a long game handicap of the golfer comprises the step of selecting a long game handicap corresponding to the calculated long game efficiency index from a table relating long game handicaps versus long game efficiency indexes.

In some embodiments, the calculated long game efficiency index is adjusted for relative difficulty of a golf course on which the at least one round of golf was played before the step of determining a long game handicap. In certain of these embodiments, the calculated long game efficiency index is adjusted for relative difficulty of a golf course on which the at least one round of golf was played by performing at least the following steps: calculating a golf course rating difference by dividing a golf course rating of the golf course on which the at least one round of golf was played by an average golf course rating of a plurality of golf courses used to formulate the known relationship between long game handicap versus long game efficiency index; calculating a slope rating difference by dividing a slope rating of the golf course on which the at least one round of golf was played by an average slope rating of a plurality of golf courses used to formulate the known relationship between long game handicap versus long game efficiency index; calculating an adjustment factor by averaging the golf course rating difference and the slope rating difference; and calculating an adjusted long game efficiency index by dividing the calculated long game efficiency index by the calculated adjustment factor.

In some embodiments, the method further includes the step of calculating a short game handicap of the golfer by performing at least the following steps: calculating a Slope Adjusted Differential for the at least one round of golf; and multiplying the Slope Adjusted Differential by 2 and then subtracting the determined long game handicap. In certain of these embodiments, the step of calculating a Slope Adjusted Differential for the at least one round of golf comprises the steps of: subtracting a golf course rating of the golf course on which the at least one round of golf was played from a final gross score of the golfer for the at least one round of golf; multiplying the result of the subtracting step by a hypothetical average slope rating for a plurality of golf courses; and dividing the result of the multiplying step by a slope rating of the golf course on which the at least one round of golf was played. In certain of these embodiments, the hypothetical average slope rating for a plurality of golf courses comprises a hypothetical average slope rating for all golf courses in the United States.

In accordance with another embodiment of the present invention, a method for analyzing performance of a golfer comprises the steps of: determining a number greens hit in regulation by the golfer during at least one round of golf, the number of greens hit in regulation comprising a number of holes on which the golfer reached a hole's putting surface in at least two strokes less than par for the hole for each hole played during the at least one round of golf; determining a number of long game strokes taken by the golfer during the at least one round of golf, the number of long game strokes comprising a number of strokes taken or incurred by the golfer from greater than 50 yards from each hole played during the at least one round of golf; calculating a long game efficiency index of the golfer by dividing the determined number of long game strokes by the determined number of greens hit in regulation; calculating a golf course rating difference by dividing a golf course rating of the golf course on which the at least one round of golf was played by an average golf course rating of a plurality of golf courses; calculating a slope rating difference by dividing a slope rating of the golf course on which the at least one round of golf was played by an average slope rating of a plurality of golf courses; calculating an adjustment factor by averaging the golf course rating difference and the slope rating difference; calculating an adjusted long game efficiency index by dividing the calculated long game efficiency index by the calculated adjustment factor; determining a long game handicap of the golfer based at least in part upon the calculated adjusted long game efficiency index by selecting a long game handicap corresponding to the calculated long game efficiency index from a table relating long game handicaps versus long game efficiency indexes; calculating a Slope Adjusted Differential for the at least one round of golf; and calculating a short game handicap of the golfer by multiplying the Slope Adjusted Differential by 2 and then subtracting the determined long game handicap.

In some embodiments, the number of strokes taken or incurred includes strokes taken by the golfer and penalty strokes incurred by the golfer. In some embodiments, the plurality of golf courses upon which the average golf course rating and the average slope rating is based comprise a plurality of golf courses used to formulate the table relating long game handicaps versus long game efficiency indexes.

In some embodiments, the step of calculating a Slope Adjusted Differential for the at least one round of golf comprises the steps of: subtracting the golf course rating of the golf course on which the at least one round of golf was played from a final gross score of the golfer for the at least one round of golf; multiplying the result of the subtracting step by a hypothetical average slope rating for a plurality of golf courses; and dividing the result of the multiplying step by a slope rating of the golf course on which the at least one round of golf was played. In certain of these embodiments, the hypothetical average slope rating for a plurality of golf courses comprises a hypothetical average slope rating for all golf courses in the United States.

In accordance with a further embodiment of the present invention, a system for analyzing performance of a golfer comprises a computer, and software executing on the computer for receiving an indication of a number greens hit in regulation by the golfer during at least one round of golf and an indication of a number of long game strokes taken by the golfer during the at least one round of golf. Software executing on the computer is provided for calculating a long game efficiency index of the golfer by dividing the number of long game strokes by the number of greens hit in regulation, for determining a long game handicap of the golfer based at least in part upon the calculated long game efficiency index and a stored relationship between long game handicap versus long game efficiency index, and for displaying the determined long game handicap to the user.

In some embodiments, the number of greens hit in regulation comprises a number of holes on which the golfer reached a hole's putting surface in at least two strokes less than par for the hole for each hole played during the at least one round of golf. In some embodiments, the number of long game strokes comprises a number of strokes taken or incurred by the golfer from greater than 50 yards from each hole played during the at least one round of golf. In certain of these embodiments, the number of strokes taken or incurred includes strokes taken by the golfer and penalty strokes incurred by the golfer. In some embodiments, the stored relationship between long game handicap versus long game efficiency index comprises a table relating long game handicaps versus long game efficiency indexes accessible by the computer, and the software executing on the computer for determining a long game handicap of the golfer comprises software executing on the computer for selecting a long game handicap corresponding to the calculated long game efficiency index from the table.

In some embodiments, the system further includes software executing on the computer for adjusting, before the long game handicap is determined, the calculated long game efficiency index for relative difficulty of a golf course on which the at least one round of golf was played. In certain of these embodiments, the software for adjusting the calculated long game efficiency index comprises: software executing on the computer for calculating a golf course rating difference by dividing a golf course rating of the golf course on which the at least one round of golf was played by an average golf course rating of a plurality of golf courses used to formulate the known relationship between long game handicap versus long game efficiency index; software executing on the computer for calculating a slope rating difference by dividing a slope rating of the golf course on which the at least one round of golf was played by an average slope rating of a plurality of golf courses used to formulate the known relationship between long game handicap versus long game efficiency index; software executing on the computer for calculating an adjustment factor by averaging the golf course rating difference and the slope rating difference; and software executing on the computer for calculating an adjusted long game efficiency index by dividing the calculated long game efficiency index by the calculated adjustment factor.

In some embodiments, the system further includes software executing on the computer for calculating a short game handicap of the golfer, the software for determining a short game handicap of the golfer comprising: software executing on the computer for calculating a Slope Adjusted Differential for the at least one round of golf; and software executing on the computer for multiplying the Slope Adjusted Differential by 2 and then subtracting the determined long game handicap. In certain of these embodiments, the software for calculating a Slope Adjusted Differential for the at least one round of golf comprises: software executing on the computer for subtracting a golf course rating of the golf course on which the at least one round of golf was played from a final gross score of the golfer for the at least one round of golf; software executing on the computer for multiplying the result obtained by the software for subtracting by a hypothetical average slope rating for a plurality of golf courses; and software executing on the computer for dividing the result obtained by the software for multiplying by a slope rating of the golf course on which the at least one round of golf was played. In certain of these embodiments, the hypothetical average slope rating for a plurality of golf courses comprises a hypothetical average slope rating for all golf courses in the United States.

In accordance with another embodiment of the present invention, a system for analyzing performance of a golfer comprises a computer, and software executing on the computer for receiving an indication of a number greens hit in regulation by the golfer during at least one round of golf and an indication of a number of long game strokes taken by the golfer during the at least one round of golf, wherein the number of greens hit in regulation comprises a number of holes on which the golfer reached a hole's putting surface in at least two strokes less than par for the hole for each hole played during the at least one round of golf, and wherein the number of long game strokes comprises a number of strokes taken or incurred by the golfer from greater than 50 yards from each hole played during the at least one round of golf. Software executing on the computer is also provided for calculating a long game efficiency index of the golfer by dividing the number of long game strokes by the number of greens hit in regulation, for calculating a golf course rating difference by dividing a golf course rating of the golf course on which the at least one round of golf was played by an average golf course rating of a plurality of golf courses, for calculating a slope rating difference by dividing a slope rating of the golf course on which the at least one round of golf was played by an average slope rating of a plurality of golf courses, for calculating an adjustment factor by averaging the golf course rating difference and the slope rating difference, and for calculating an adjusted long game efficiency index by dividing the calculated long game efficiency index by the calculated adjustment factor. A table relating long game handicaps versus long game efficiency indexes is accessible by the computer, and software executing on the computer is also provided for selecting a long game handicap corresponding to the calculated adjusted long game efficiency index from the table, for calculating a Slope Adjusted Differential for the at least one round of golf, for calculating a short game handicap of the golfer by multiplying the Slope Adjusted Differential by 2 and then subtracting the determined long game handicap, and for displaying the selected long game handicap and the determined short game handicap to the user.

In some embodiments, the number of strokes taken or incurred includes strokes taken by the golfer and penalty strokes incurred by the golfer. In some embodiments, the plurality of golf courses upon which the average golf course rating and the average slope rating is based comprise a plurality of golf courses used to formulate the table relating long game handicaps versus long game efficiency indexes. In some embodiments, the software for calculating a Slope Adjusted Differential for the at least one round of golf comprises: software executing on the computer for subtracting the golf course rating of the golf course on which the at least one round of golf was played from a final gross score of the golfer for the at least one round of golf; software executing on the computer for multiplying the result obtained by the software for subtracting by a hypothetical average slope rating for a plurality of golf courses; and software executing on the computer for dividing the result obtained by the software for multiplying by a slope rating of the golf course on which the at least one round of golf was played. In certain of these embodiments, the hypothetical average slope rating for a plurality of golf courses comprises a hypothetical average slope rating for all golf courses in the United States.

The invention and its particular features and advantages will become more apparent from the following detailed description considered with reference to the accompanying drawings.

DETAILED DESCRIPTION OF AN EMBODIMENT OF THE INVENTION

Figure 1:
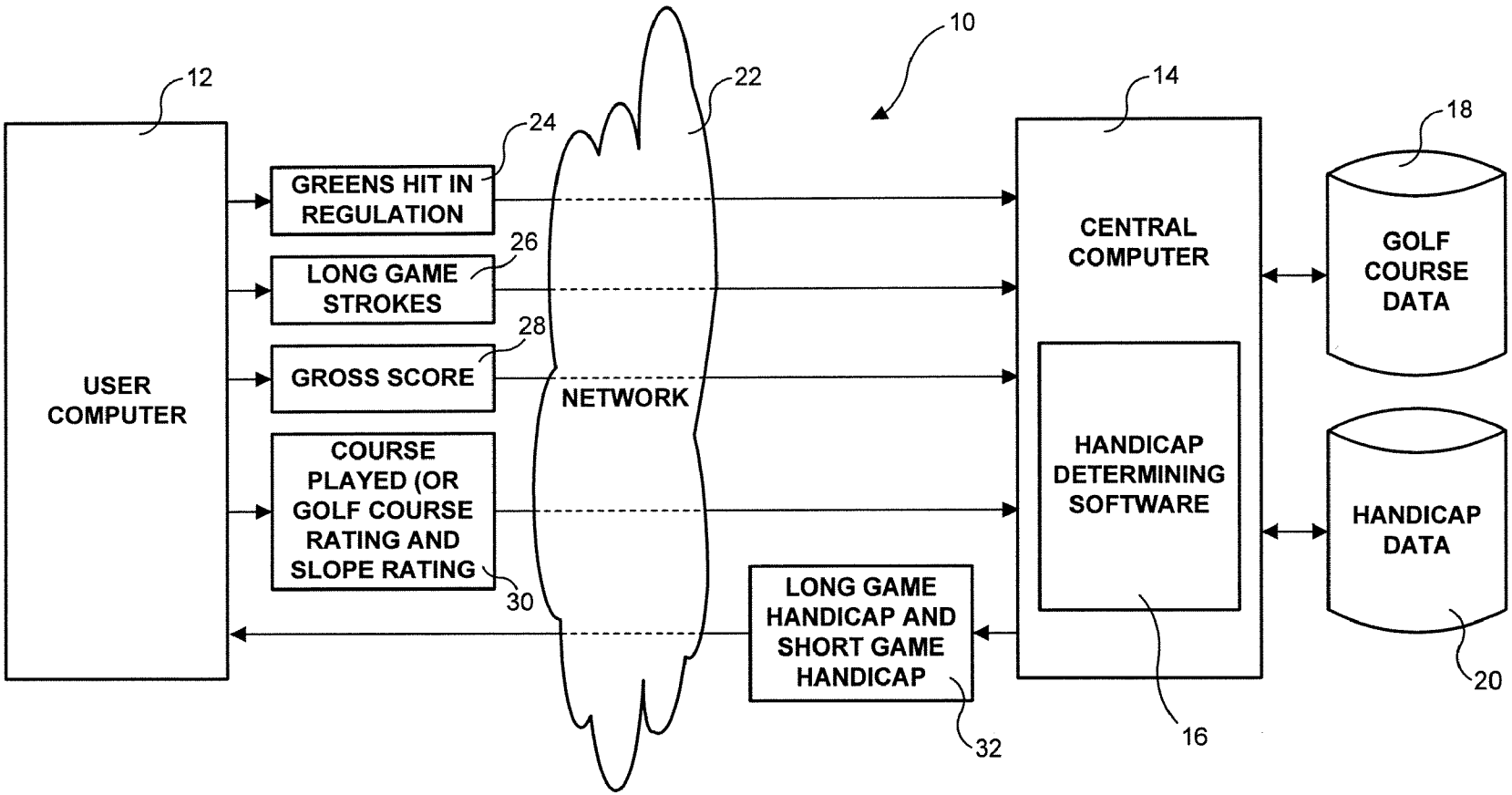
FIG. 1 is schematic view illustrating a system for analyzing performance of a golfer in accordance with an embodiment of the present invention.

Referring first to FIG. 1, a system 10 for analyzing performance of a golfer in accordance with an embodiment of the present invention is shown. The system 10 includes a user computer 12 and a central computer 14 having handicap determining software 16 executing thereon for performing calculations and various other functions as described in more detail below. Central computer 14 is in communication with golf course data storage 18 and handicap data storage 20, which may comprise, for example, databases or various other types of storage devices. The data stored on golf course data storage 18 and handicap data storage 20 is described below as necessary.

As shown in FIG. 1, user computer 12 and central computer 14 may comprise two separate computer systems in communication with one another via a network 22, such as the Internet, a local area network, a wide area network, a virtual private network, etc. When such is the case, user computer 12 may interface with central computer 14 via a web browser or the like, or user computer 12 may have a dedicated software application installed thereon. If desired, however, user computer 12 and central computer 14 may be combined into a single computer operated by a user, with handicap determining software 16 executing thereon.

In order to implement the inventive system and method of the present invention, the player or an appropriate authority keeps track of at least the following two pieces of data for at least one round of golf played: (i) greens hit in regulation (GIR's), which is typically defined as a number of holes on which the golfer reached the hole's putting surface in at least two strokes less than par for the hole for each hole played during the at least one round of golf (e.g., reaching the putting surface in 3 strokes or less on a par 5 hole, 2 strokes or less on a par 4 hole and 1 stroke on a par 3 hole), and (ii) long game strokes, which is typically defined as a number of strokes taken or incurred by the golfer (including penalty strokes) from greater than 50 yards from each hole played during the at least one round of golf. In recording long game strokes, for unfinished holes (i.e., pick-ups), the long game strokes may be counted or an estimate may be made as to what they would have been to get within 50 yards of the hole. As discussed in more detail below in connection with certain embodiments of the present invention, the golfer's gross score for the at least one round of golf may also be recorded.

The user of system 10 inputs the number greens hit in regulation 24 by the golfer during the at least one round of golf, the number of long game strokes 26 taken by the golfer during the at least one round of golf and the gross score 28 incurred by the golfer during the at least one round of golf. The user also inputs an indication 30 of the golf course played during the at least one round of golf, which information is used by central computer 14 to retrieve the corresponding golf course rating and the slope rating for the course played from the golf course data storage 18, or alternatively, the indication 30 itself may include the golf course rating and the slope rating.

With this information, as well as information retrieved from golf course data storage 18 and handicap data storage 20, handicap determining software 16 executing on central computer 14 calculates the golfer's long game handicap and short game handicap 32, and transmits this information to user computer 12 for display to the user of system 10.

golf courses used to formulate a known relationship between long game handicap versus long game efficiency index, as described more fully below. An adjustment factor is then calculated, as shown at 40 by averaging the golf course rating difference and the slope rating difference, and an adjusted long game efficiency index is calculated, as shown at 42, by dividing the calculated long game efficiency index by the calculated adjustment factor.

Next, as shown at 44, a long game handicap of the golfer is determined based at least in part upon the calculated adjusted long game efficiency index and a known relationship between long game handicap versus long game efficiency index. This known relationship may comprise, for example, a table relating long game handicaps versus long game efficiency indexes, as shown below:

TABLE 1

Long Game Efficiency Index vs. Long Game Handicap

| | Handicap | | | | | | | | | | | |
|---|---|---|---|---|---|---|---|---|---|---|---|---|
| | +6 | +5 | +4 | +3 | +2 | +1 | 0 | 1 | 2 | 3 | 4 | 5 |
| Index | 2.5 | 2.57 | 2.63 | 2.69 | 2.75 | 2.89 | 3.04 | 3.18 | 3.4 | 3.62 | 3.85 | 4.15 |
| | Handicap | | | | | | | | | | | |
| | 6 | 7 | 8 | 9 | 10 | 11 | 12 | 13 | 14 | 15 | 16 | 17 |
| Index | 4.45 | 4.75 | 5.05 | 5.44 | 5.90 | 6.2 | 6.6 | 7.2 | 7.8 | 8.3 | 8.9 | 9.5 |
| | Handicap | | | | | | | | | | | |
| | 18 | 19 | 20 | 21 | 22 | 23 | 24 | 25 | 26 | 27 | 28 | 29 |
| Index | 10.4 | 11.3 | 12.2 | 13 | 14 | 14.8 | 15.6 | 16.4 | 17.2 | 18 | 20 | 22 |
| | Handicap | | | | | | | | | | | |
| | 30 | 31 | 32 | 33 | 34 | 35 | 36 | 37 | 38 | 39 | 40 | |
| Index | 24 | 26 | 28.7 | 31 | 33 | 35 | 37 | 39 | 41 | 43 | 45 | |

Figure 2:
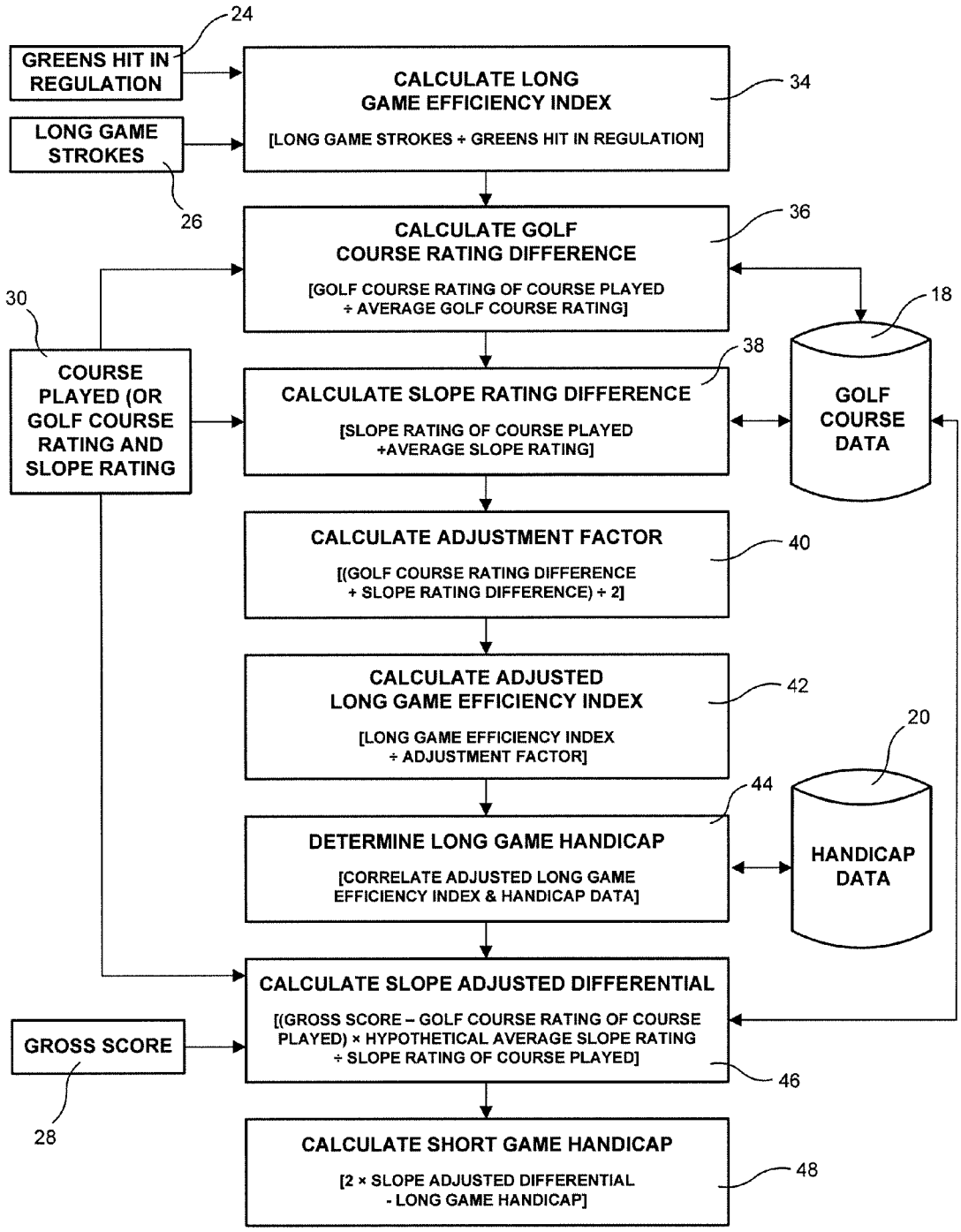
FIG. 2 is a schematic flow chart illustrating a method for analyzing performance of a golfer in accordance with an embodiment of the present invention, which method may be performed by the system of FIG. 1.

Referring now to FIG. 2, the various calculations and other operations performed by handicap determining software 16 are shown. As shown at 34, a long game efficiency index of the golfer is calculated by dividing the number of long game strokes 26 by the number of greens hit in regulation 24. Next, as shown at 36 a golf course rating difference is calculated by dividing a golf course rating of the golf course on which the at least one round of golf was played by an average golf course rating of a plurality of golf courses. The golf course rating of the golf course on which the at least one round of golf was played may be retrieved from golf course data storage 18, based upon the indication 30 of the golf course played, or may be supplied as part of the indication 30 itself. The plurality of golf courses upon which the average golf course rating is based is a plurality of golf courses used to formulate a known relationship between long game handicap versus long game efficiency index, as described more fully below.

A slope rating difference is calculated, as shown at 38, by dividing a slope rating of the golf course on which the at least one round of golf was played by an average slope rating of a plurality of golf courses. The slope rating of the golf course on which the at least one round of golf was played may be retrieved from golf course data storage 18, based upon the indication 30 of the golf course played, or may be supplied as part of the indication 30 itself. The plurality of golf courses upon which the average slope rating is based is a plurality of It should be noted that while adjusting the long game efficiency index for relative difficulty of the golf course played may be desirable, and may provide more accurate results, such is not strictly necessary, such that the steps 36-42 may be omitted, and the long game efficiency index calculated in step 34 may be used in step 44 to determine the long game handicap.

It may also be desirable to determine a short game handicap in order to help the golfer evaluate his/her short game in addition to his/her long game. In order to accomplish this, as shown at 46, a Slope Adjusted Differential for the at least one round of golf is calculated. This calculation may be performed by subtracting a golf course rating of the golf course on which the at least one round of golf was played from a final gross score 28 of the golfer for the at least one round of golf, multiplying the result by a hypothetical average slope rating for a plurality of golf courses, and dividing the result by a slope rating of the golf course on which the at least one round of golf was played. The hypothetical average slope rating for a plurality of golf courses may comprise a hypothetical average slope rating for all golf courses in the United States, such as disseminated by the United States Golf Association.

Next, as shown at 48, a short game handicap of the golfer is calculated by multiplying the Slope Adjusted Differential by 2 and then subtracting the determined long game handicap.

The above calculations may be repeated for several (e.g. 3 to 5) rounds of golf, and the average of the long and short game handicaps may be determined. These handicaps will provide a fairly accurate picture of the player's strength and weakness.

EXAMPLE

The following example provides the results of calculations in accordance with the above described method, system and computer software of the invention, for a typical golfer with a 15 handicap.

This Example supposes that in a round of golf the golfer had a gross score of 89, recorded 6 greens hit in regulation and accrued 38 long game strokes, and that the golf course rating of the course played is 73, while the slope rating of the course played is 138. This Example also supposes that Table 1 is employed for the relationship between long game handicap versus long game efficiency index, which Table is based upon a plurality of golf courses stored in the SHOT BY SHOT database maintained by Golf Research Associates l.p., and that the average golf course rating and the average slope rating for the plurality of courses comprising this database are 71.5 and 130, respectively. This Example further supposes that the hypothetical average slope rating for all golf courses in the United States disseminated by the United States Golf Association is 113. Of course, it should be recognized that all of these numbers may vary, and are used for purposes of this example only.

Based upon the exemplary information, the golfer's long game efficiency index is 6.33 (38÷6). The golf course rating difference is 1.02 (73÷71.5) and the slope rating difference is 1.06 (138÷130), which makes the adjustment factor 1.04 ((1.02+1.04)÷2). Thus, the golfer's adjusted long game efficiency index would be 6.09 (6.33÷1.04). By examining Table 1, it is determined that the player's long game handicap is, therefore, 11. Continuing on, the player's Slope Adjusted Differential is 13.1 ((89−73)×113÷138). Thus, the golfer's short game handicap is 15(2×13.1−11).

This example reveals that the golfer has a better long game than a short game, as a higher handicap is associated with the golfer's short game. This analysis then can be used by the golfer to improve his/her average score by focusing on improving the short game.

The present invention, therefore, provides a system and method for analyzing performance of golfers which provide an indication of the golfer's efficiency in the long game, which take into account a golfer's performance on all holes, which provide a comparative analysis of the golfer's long game as compared to his/her short game, and which assign an accurate handicap to the golfer's long game performance and short game performance.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A tangible computer readable storage medium including a set of instructions executable by a processor, the set of instructions operable to analyze the performance of a golfer by:

determining a number of greens hit in regulation by the golfer during at least one round of golf;

determining a number of long game strokes taken by the golfer during the at least one round of golf;

determining one of at least a golf course rating difference and a slope rating difference for the course on which the at least one round of golf is played;

calculating a long game efficiency index of the golfer by dividing the determined number of long game strokes by the determined number of greens hit in regulation; and determining a long game handicap of the golfer based at least in part upon the calculated long game efficiency index, a known relationship between long game handicap versus long game efficiency index, and one of at least the golf course rating difference and the slope rating difference.

2. The tangible computer readable storage medium of claim 1 wherein the number of greens hit in regulation comprises a number of holes on which the golfer reached a hole's putting surface in at least two strokes less than par for the hole for each hole played during the at least one round of golf.

3. The tangible computer readable storage medium of claim 1 wherein the number of long game strokes comprises a number of strokes taken or incurred by the golfer from greater than 50 yards from each hole played during the at least one round of golf.

4. The tangible computer readable storage medium of claim 3 wherein the number of strokes taken or incurred includes strokes taken by the golfer and penalty strokes incurred by the golfer.

5. The tangible computer readable storage medium of claim 1 wherein said step of determining a long game handicap of the golfer comprises the step of selecting a long game handicap corresponding to the calculated long game efficiency index from a table relating long game handicaps versus long game efficiency indexes.

6. The tangible computer readable storage medium of claim 1 wherein said calculated long game efficiency index is adjusted for relative difficulty of a golf course on which the at least one round of golf was played before said step of determining a long game handicap.

7. The tangible computer readable storage medium of claim 6 wherein said calculated long game efficiency index is adjusted for relative difficulty of a golf course on which the at least one round of golf was played by performing at least the following steps:

calculating the golf course rating difference by dividing a golf course rating of the golf course on which the at least one round of golf was played by an average golf course rating of a plurality of golf courses used to formulate the known relationship between long game handicap versus long game efficiency index;

calculating the slope rating difference by dividing a slope rating of the golf course on which the at least one round of golf was played by an average slope rating of a plurality of golf courses used to formulate the known relationship between long game handicap versus long game efficiency index;

calculating an adjustment factor by averaging the golf course rating difference and the slope rating difference; and calculating an adjusted long game efficiency index by dividing the calculated long game efficiency index by the calculated adjustment factor.

8. The tangible computer readable storage medium of claim 1 further comprising the step of calculating a short game handicap of the golfer by performing at least the following steps:

calculating a Slope Adjusted Differential for the at least one round of golf; and multiplying the Slope Adjusted Differential by 2 and then subtracting the determined long game handicap.

9. The tangible computer readable storage medium of claim 8 wherein said step of calculating a Slope Adjusted Differential for the at least one round of golf comprises the steps of:

subtracting a golf course rating of the golf course on which the at least one round of golf was played from a final gross score of the golfer for the at least one round of golf;

multiplying the result of said subtracting step by a hypothetical average slope rating for a plurality of golf courses; and dividing the result of said multiplying step by a slope rating of the golf course on which the at least one round of golf was played.

10. The tangible computer readable storage medium of claim 9 wherein the hypothetical average slope rating for a plurality of golf courses comprises a hypothetical average slope rating for all golf courses in the United States.

11. The tangible computer readable storage medium of claim 1 wherein the determining of the long game handicap of the golfer based at least in part upon the golf course rating difference and the slope rating difference.

12. A tangible computer readable storage medium including a set of instructions executable by a processor, the set of instructions operable to analyze the performance of a golfer by:

determining a number of greens hit in regulation by the golfer during at least one round of golf, the number of greens hit in regulation comprising a number of holes on which the golfer reached a hole's putting surface in at least two strokes less than par for the hole for each hole played during the at least one round of golf;

determining a number of long game strokes taken by the golfer during the at least one round of golf, the number of long game strokes comprising a number of strokes taken or incurred by the golfer from greater than 50 yards from each hole played during the at least one round of golf;

calculating a long game efficiency index of the golfer by dividing the determined number of long game strokes by the determined number of greens hit in regulation;

calculating a golf course rating difference by dividing a golf course rating of the golf course on which the at least one round of golf was played by an average golf course rating of a plurality of golf courses;

calculating a slope rating difference by dividing a slope rating of the golf course on which the at least one round of golf was played by an average slope rating of a plurality of golf courses;

calculating an adjustment factor by averaging the golf course rating difference and the slope rating difference;

calculating an adjusted long game efficiency index by dividing the calculated long game efficiency index by the calculated adjustment factor;

determining a long game handicap of the golfer based at least in part upon the calculated adjusted long game efficiency index by selecting a long game handicap corresponding to the calculated long game efficiency index from a table relating long game handicaps versus long game efficiency indexes;

calculating a Slope Adjusted Differential for the at least one round of golf; and calculating a short game handicap of the golfer by multiplying the Slope Adjusted Differential by 2 and then subtracting the determined long game handicap.

13. The tangible computer readable storage medium of claim 12 wherein the number of strokes taken or incurred includes strokes taken by the golfer and penalty strokes incurred by the golfer.

14. The tangible computer readable storage medium of claim 12 wherein the plurality of golf courses upon which the average golf course rating and the average slope rating is based comprise a plurality of golf courses used to formulate the table relating long game handicaps versus long game efficiency indexes.

15. The tangible computer readable storage medium of claim 12 wherein said step of calculating a Slope Adjusted Differential for the at least one round of golf comprises the steps of:

subtracting the golf course rating of the golf course on which the at least one round of golf was played from a final gross score of the golfer for the at least one round of golf;

multiplying the result of said subtracting step by a hypothetical average slope rating for a plurality of golf courses; and dividing the result of said multiplying step by a slope rating of the golf course on which the at least one round of golf was played.

16. The tangible computer readable storage medium of claim 12 wherein the hypothetical average slope rating for a plurality of golf courses comprises a hypothetical average slope rating for all golf courses in the United States.

17. A system for analyzing performance of a golfer comprising:

a computer;

software executing on said computer for receiving an indication of a number of greens hit in regulation by the golfer during at least one round of golf and an indication of a number of long game strokes taken by the golfer during the at least one round of golf;

software executing on said computer for calculating a long game efficiency index of the golfer by dividing the number of long game strokes by the number of greens hit in regulation;

software executing on said computer for determining at least one of a golf course rating difference and a slope rating difference for the golf course on which the at least one round of gold is played;

software executing on said computer for determining a long game handicap of the golfer based at least in part upon the calculated long game efficiency index, a stored relationship between long game handicap versus long game efficiency index, and one of at least the golf course rating difference and the slope rating difference; and software executing on said computer for displaying the determined long game handicap to the user.

18. The system of claim 17 wherein the number of greens hit in regulation comprises a number of holes on which the golfer reached a hole's putting surface in at least two strokes less than par for the hole for each hole played during the at least one round of golf.

19. The system of claim 17 wherein the number of long game strokes comprises a number of strokes taken or incurred by the golfer from greater than 50 yards from each hole played during the at least one round of golf.

20. The system of claim 19 wherein the number of strokes taken or incurred includes strokes taken by the golfer and penalty strokes incurred by the golfer.

21. The system of claim 17 wherein the stored relationship between long game handicap versus long game efficiency index comprises a table relating long game handicaps versus long game efficiency indexes accessible by said computer, and wherein said software executing on said computer for determining a long game handicap of the golfer comprises software executing on said computer for selecting a long game handicap corresponding to the calculated long game efficiency index from the table.

22. The system of claim 17 further comprising software executing on said computer for adjusting, before the long game handicap is determined, the calculated long game efficiency index for relative difficulty of a golf course on which the at least one round of golf was played.

23. The system of claim 22 wherein said software for adjusting the calculated long game efficiency index comprises:

software executing on said computer for calculating the golf course rating difference by dividing a golf course rating of the golf course on which the at least one round of golf was played by an average golf course rating of a plurality of golf courses used to formulate the known relationship between long game handicap versus long game efficiency index;

software executing on said computer for calculating the slope rating difference by dividing a slope rating of the golf course on which the at least one round of golf was played by an average slope rating of a plurality of golf courses used to formulate the known relationship between long game handicap versus long game efficiency index;

software executing on said computer for calculating an adjustment factor by averaging the golf course rating difference and the slope rating difference; and software executing on said computer for calculating an adjusted long game efficiency index by dividing the calculated long game efficiency index by the calculated adjustment factor.

24. The system of claim 17 further comprising software executing on said computer for calculating a short game handicap of the golfer, said software for determining a short game handicap of the golfer comprising:

software executing on said computer for calculating a Slope Adjusted Differential for the at least one round of golf; and software executing on said computer for multiplying the Slope Adjusted Differential by 2 and then subtracting the determined long game handicap.

25. The system of claim 24 wherein said software for calculating a Slope Adjusted Differential for the at least one round of golf comprises:

software executing on said computer for subtracting a golf course rating of the golf course on which the at least one round of golf was played from a final gross score of the golfer for the at least one round of golf;

software executing on said computer for multiplying the result obtained by said software for subtracting by a hypothetical average slope rating for a plurality of golf courses; and software executing on said computer for dividing the result obtained by said software for multiplying by a slope rating of the golf course on which the at least one round of golf was played.

26. The system of claim 25 wherein the hypothetical average slope rating for a plurality of golf courses comprises a hypothetical average slope rating for all golf courses in the United States.

27. The system of claim 17 wherein the determining of the long game handicap of the golfer based at least in part upon the golf course rating difference and the slope rating difference.

28. A system for analyzing performance of a golfer comprising:

a computer;

software executing on said computer for receiving an indication of a number of greens hit in regulation by the golfer during at least one round of golf and an indication of a number of long game strokes taken by the golfer during the at least one round of golf, wherein the number of greens hit in regulation comprises a number of holes on which the golfer reached a hole's putting surface in at least two strokes less than par for the hole for each hole played during the at least one round of golf, and wherein the number of long game strokes comprises a number of strokes taken or incurred by the golfer from greater than 50 yards from each hole played during the at least one round of golf;

software executing on said computer for calculating a long game efficiency index of the golfer by dividing the number of long game strokes by the number of greens hit in regulation;

software executing on said computer for calculating a golf course rating difference by dividing a golf course rating of the golf course on which the at least one round of golf was played by an average golf course rating of a plurality of golf courses;

software executing on said computer for calculating a slope rating difference by dividing a slope rating of the golf course on which the at least one round of golf was played by an average slope rating of a plurality of golf courses;

software executing on said computer for calculating an adjustment factor by averaging the golf course rating difference and the slope rating difference;

software executing on said computer for calculating an adjusted long game efficiency index by dividing the calculated long game efficiency index by the calculated adjustment factor;

a table relating long game handicaps versus long game efficiency indexes accessible by said computer;

software executing on said computer for selecting a long game handicap corresponding to the calculated adjusted long game efficiency index from the table;

software executing on said computer for calculating a Slope Adjusted Differential for the at least one round of golf;

software executing on said computer for calculating a short game handicap of the golfer by multiplying the Slope Adjusted Differential by 2 and then subtracting the determined long game handicap; and software executing on said computer for displaying the selected long game handicap and the determined short game handicap to the user.

29. The system of claim 28 wherein the number of strokes taken or incurred includes strokes taken by the golfer and penalty strokes incurred by the golfer.

30. The system of claim 28 wherein the plurality of golf courses upon which the average golf course rating and the average slope rating is based comprise a plurality of golf courses used to formulate the table relating long game handicaps versus long game efficiency indexes.

31. The system of claim 28 wherein said software for calculating a Slope Adjusted Differential for the at least one round of golf comprises:

software executing on said computer for subtracting the golf course rating of the golf course on which the at least one round of golf was played from a final gross score of the golfer for the at least one round of golf;

software executing on said computer for multiplying the result obtained by said software for subtracting by a hypothetical average slope rating for a plurality of golf courses; and software executing on said computer for dividing the result obtained by said software for multiplying by a slope rating of the golf course on which the at least one round of golf was played.

32. The system of claim 31 wherein the hypothetical average slope rating for a plurality of golf courses comprises a hypothetical average slope rating for all golf courses in the United States.

33. A tangible computer readable storage medium including a set of instructions executable by a processor, the set of instructions operable to analyze the performance of a golfer by:

determining a number of greens hit in regulation by the golfer during at least one round of golf;

determining a number of long game strokes taken by the golfer during the at least one round of golf, wherein the number of long game strokes comprises a number of strokes taken or incurred by the golfer from greater than 50 yards from each hole played during the at least one round of golf;

calculating a long game efficiency index of the golfer by dividing the determined number of long game strokes by the determined number of greens hit in regulation; and determining a long game handicap of the golfer based at least in part upon the calculated long game efficiency index and a known relationship between long game handicap versus long game efficiency index.

* * * * *